US005383804A

United States Patent [19]

Mitch et al.

[11] Patent Number: 5,383,804

[45] Date of Patent: Jan. 24, 1995

[54] SKI TUBE

[76] Inventors: Joseph E. Mitch; Klara D. Mitch, both of 655 Carlson Ct., Rohnert Park, Calif. 94928

[21] Appl. No.: 138,911

[22] Filed: Oct. 19, 1993

Related U.S. Application Data

[63] Continuation-in-part of Ser. No. 783,090, Oct. 18, 1991, Pat. No. Des. 340,495.

[51] Int. Cl.[6] ..... B63B 7/08

[52] U.S. Cl. ..... 441/66; 441/67

[58] Field of Search ..... 441/66, 67, 131

[56] References Cited

U.S. PATENT DOCUMENTS

| | | | |
|---|---|---|---|
| 2,075,374 | 3/1937 | Tucker | 441/131 |
| 2,529,961 | 11/1950 | Phillips | 441/131 |
| 3,581,328 | 6/1971 | Smith | 441/67 |
| 4,619,620 | 10/1986 | Felter | 441/66 |
| 4,635,581 | 1/1987 | Scheurer | 441/67 X |

*Primary Examiner*—Sherman Basinger

*Attorney, Agent, or Firm*—Larry D. Johnson

[57] ABSTRACT

A ski tube includes a torus-shaped innertube, a generally torus-shaped cover member bearing a continuous zipper or other releasable fastener preferably along a circumference thereof, a base portion, and a generally V-shaped towing flap member adapted for releasable capture of a tow rope handle.

3 Claims, 1 Drawing Sheet

SKI TUBE

This application is a continuation-in-part of application Ser. No. 07/783,090, file Oct. 18, 1991, and now U.S. Pat. No. D 340,495.

BACKGROUND OF THE INVENTION

1. Field of the Invention

This invention relates generally to water sports apparatus, and more specifically to an improved inflatable water recreation device.

2. Description of the Prior Art

Inflatable tubes as used in water sports are well known. These tubes typically consists of a large inflatable innertube that may or may not be partially covered with a plastic or canvas-like material, and which is attached to a line and towed behind a power boat. However, known ski tubes still leave at least some portion of the innertube exposed to the elements, and leave edges on the cover which are prone to catch hands, fingers, etc. when in use. In addition, known tubes are difficult to attach and detach from a tow line, because most tow lines terminate in a rigid handle designed to be grasped by the user's hands.

SUMMARY OF THE INVENTION

The ski tube of this invention provides an improved inflatable water recreation device including a torus-shaped innertube, a generally torus-shaped cover member bearing a continuous zipper or other releasable fastening means preferably along a circumference thereof, a base portion, and a generally V-shaped towing flap member attached to the lower edge of the cover and adapted for releasable capture of a tow rope handle. The complete enclosure of the innertube by the torus-shaped cover member protects the innertube from exposure to the elements, and avoids the presence of edges on the cover which might catch the user's hands or fingers when in use. The novel towing flap enables a ski rope handle to be inserted into the V-shaped towing flap and captured there by one or more straps, thereby enabling quick and easy attachment and release of a tow rope from the tube. Alternatively, a tow rope may be simply tied or otherwise fastened to a towing ring incorporated onto the front end of the flap.

DETAILED DESCRIPTION OF A PREFERRED EMBODIMENT

Figure 1:
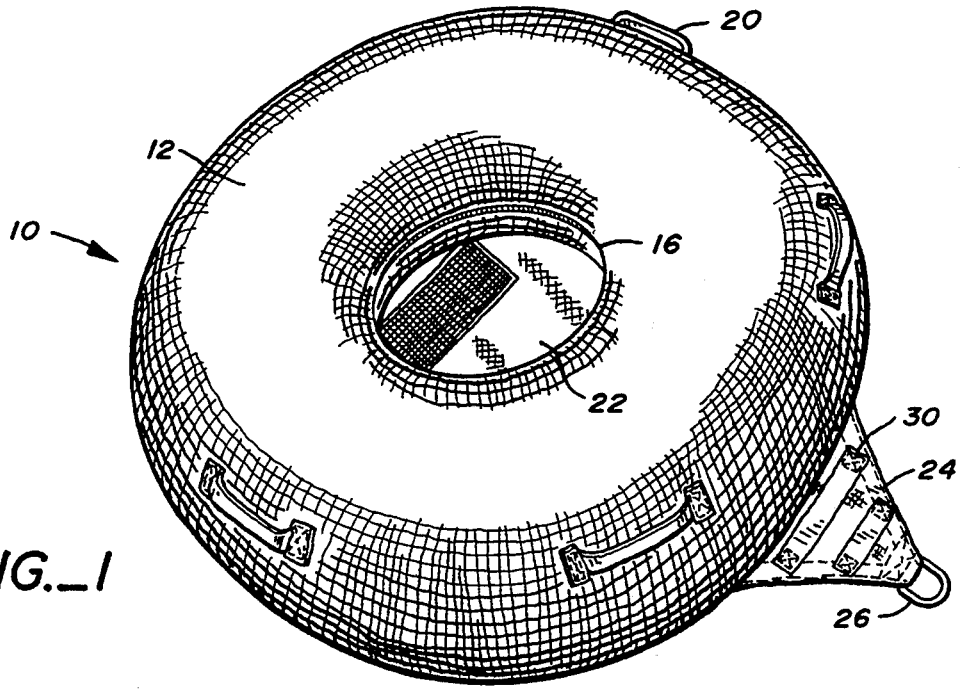
FIG. 1 is a perspective view of the ski tube of this invention illustrating the torus-shaped cover member (covering the innertube, not visible in this view), bearing a continuous zipper along its inner circumference, and having a plurality of handles, a base portion, and a towing flap portion including a towing ring and at least one tow rope handle capture strap.

FIG. 1 is a perspective view of the ski tube 10 of this invention illustrating the torus-shaped cover member 12 (covering the innertube, not visible in this view), bearing a continuous zipper 16 along its inner circumference, and having a plurality of handles 20, a base portion 22, and a towing flap portion 24 including a towing ring (D-ring) 26 and at least one tow rope handle capture strap 30.

Figure 2:
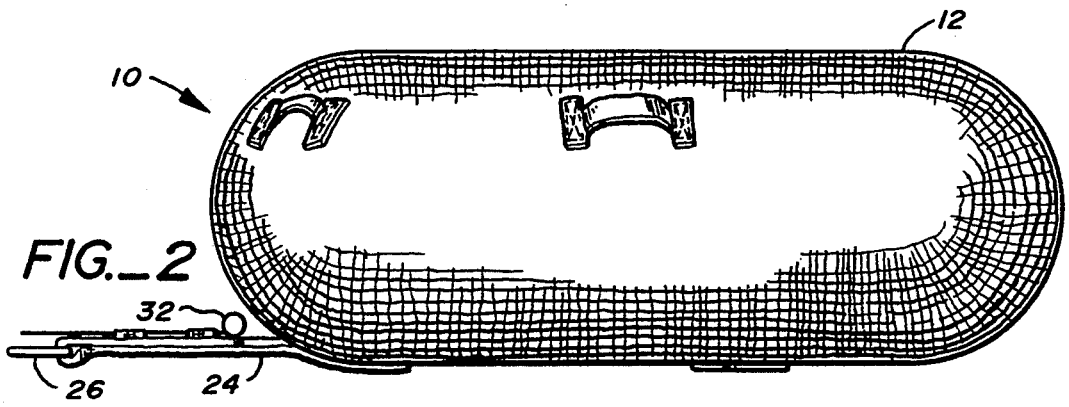
FIG. 2 is a side elevation view of the ski tube of this invention, illustrating a typical tow rope handle as captured by a towing flap capture strap.

FIG. 2 is a side elevation view of the ski tube 10 of this invention, illustrating a typical tow rope handle 32 as captured by a towing flap 24 capture strap 30. To install, the ski rope may be pulled through the two straps backwards, leaving the ski handle in place behind strap 30 as illustrated.

Figure 3:
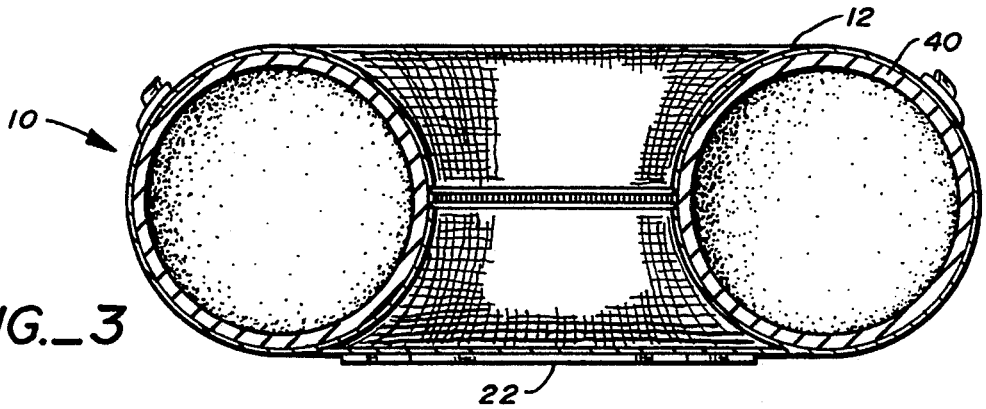
FIG. 3 is a side elevation cross-sectional view of the ski tube of this invention illustrating the torus-shaped cover member completely covering the innertube.

FIG. 3 is a side elevation cross-sectional view of the ski tube 10 of this invention illustrating the torus-shaped cover member 12 completely covering the innertube 40. The innertube is preferably made of thirty gauge PVC or similar sturdy material, while the cover is preferably made of 850 denier nylon with a PVC coating or a similar material. The base 22 preferably extends completely across and between the respective sides of the torus-shaped tube and cover, thereby providing a superior planing surface.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A ski tube comprising:

a torus-shaped inflatable innertube; and a torus-shaped cover member including a continuous fastener, said cover member adapted for removable covering of said innertube, said cover member having a base portion; and a towing flap portion connected to said cover member base portion and adapted for releasable capture of a tow rope handle, said towing flap portion including at least one strap element for capture of said tow rope handle.

2. The ski tube of claim 1 wherein said cover member includes at least one handle member.

3. The ski tube of claim 1 wherein said torus-shaped cover member has an inner circumference, and said continuous fastener comprises a zipper extending along said inner circumference.

* * * * *